United States Patent [19]

Battah

[11] Patent Number: 4,486,148

[45] **Date of Patent: * Dec. 4, 1984**

[54] METHOD OF CONTROLLING A MOTIVE POWER AND FLUID DRIVING SYSTEM

[75] Inventor: Husam Battah, Troy, Mich.

[73] Assignee: Michigan Consolidated Gas Company, Detroit, Mich.

[ * ] Notice: The portion of the term of this patent subsequent to May 18, 1999 has been disclaimed.

[21] Appl. No.: 379,021

[22] Filed: May 17, 1982

Related U.S. Application Data

[63] Continuation-in-part of Ser. No. 88,785, Oct. 29, 1979, Pat. No. 4,330,237.

[51] Int. Cl.[3] ..... F04B 41/06; F04B 49/00

[52] U.S. Cl. ..... 417/2; 417/26; 417/34; 417/42; 417/53; 417/253; 417/275

[58] Field of Search ..... 417/53, 42, 44, 45, 417/22, 18, 29, 2, 26, 43, 34, 274–277, 33, 252, 253, 9, 13, 19, 20

[56] References Cited

U.S. PATENT DOCUMENTS

| | | | |
|---|---|---|---|
| 2,339,957 | 1/1944 | Smith . | |
| 2,629,536 | 2/1953 | Baker . | |
| 2,789,755 | 4/1957 | Lamberton . | |
| 3,043,495 | 7/1962 | Hewitt . | |
| 3,068,796 | 12/1962 | Pfluger et al. . | |
| 3,088,656 | 5/1963 | Hartley . | |
| 3,251,534 | 5/1966 | Strecker . | |
| 3,291,378 | 12/1966 | Yarnall, Jr. . | |
| 3,563,672 | 2/1971 | Bergstrom | 417/45 |
| 3,699,810 | 10/1972 | Takahaski . | |
| 3,716,305 | 2/1973 | Oberlander . | |
| 3,731,070 | 5/1973 | Urban . | |
| 3,753,626 | 8/1973 | Bacchi . | |
| 3,826,904 | 7/1974 | Leonard et al. . | |
| 3,860,363 | 1/1975 | Silvern et al. . | |
| 3,875,380 | 4/1975 | Rankin . | |
| 3,876,872 | 4/1975 | Spitz . | |
| 3,878,376 | 4/1975 | Sholes, Jr. et al. . | |
| 3,891,836 | 6/1975 | Lee . | |
| 3,898,441 | 8/1975 | Davis et al. . | |
| 3,934,128 | 1/1976 | Uram . | |
| 3,947,665 | 3/1976 | Hundley . | |
| 4,037,598 | 7/1977 | Georgi . | |
| 4,048,964 | 9/1977 | Kissel . | |
| 4,055,082 | 10/1977 | November . | |
| 4,069,675 | 1/1978 | Adler et al. . | |
| 4,088,875 | 5/1978 | Podolsky et al. . | |
| 4,108,574 | 8/1978 | Bartley et al. . | |
| 4,109,313 | 8/1978 | Donohue et al. . | |
| 4,115,848 | 9/1978 | Kogure et al. . | |
| 4,119,391 | 10/1978 | Rutshtein et al. . | |
| 4,137,011 | 1/1979 | Rock . | |
| 4,145,161 | 3/1979 | Skinner | 417/45 X |
| 4,146,923 | 3/1979 | Borkan . | |
| 4,151,718 | 5/1979 | Gravely, Sr. . | |
| 4,171,931 | 10/1979 | Harada . | |
| 4,178,132 | 12/1979 | Shiraishi et al. . | |
| 4,204,808 | 5/1980 | Reese et al. . | |
| 4,208,871 | 6/1980 | Riple, Jr. . | |
| 4,227,862 | 10/1980 | Andrew et al. . | |
| 4,330,237 | 5/1982 | Battah | 417/2 |

OTHER PUBLICATIONS

J. B. Anderson, "Documentation of the Benedict–Webb–Rubin Mark 2 Program", pp. T75–T84.

*Primary Examiner*—Edward K. Look
*Attorney, Agent, or Firm*—Harness, Dickey & Pierce

[57] ABSTRACT

A method of controlling a motive power and fluid driving system according to the present invention is disclosed, which generally comprises the steps of sensing a plurality of operating parameters and at least one control parameter defining the energy quotient for the motive power and fluid driving system, and adjusting the control parameter(s) to substantially maximize the energy quotient for the system. The control method may also include the step of substantially maximizing the energy quotient at a predetermined or desired capacity of fluid flow.

21 Claims, 9 Drawing Figures

Fig. 5
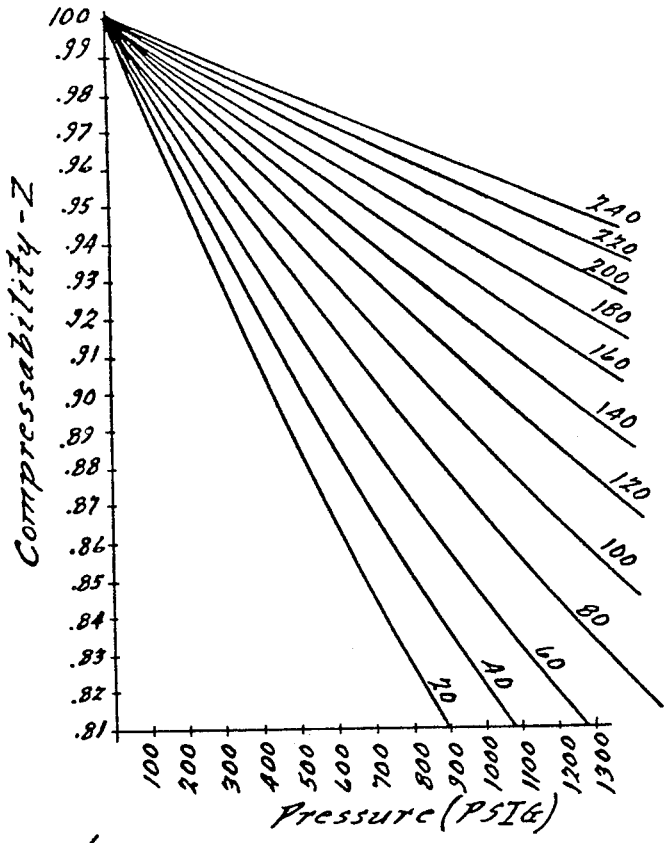
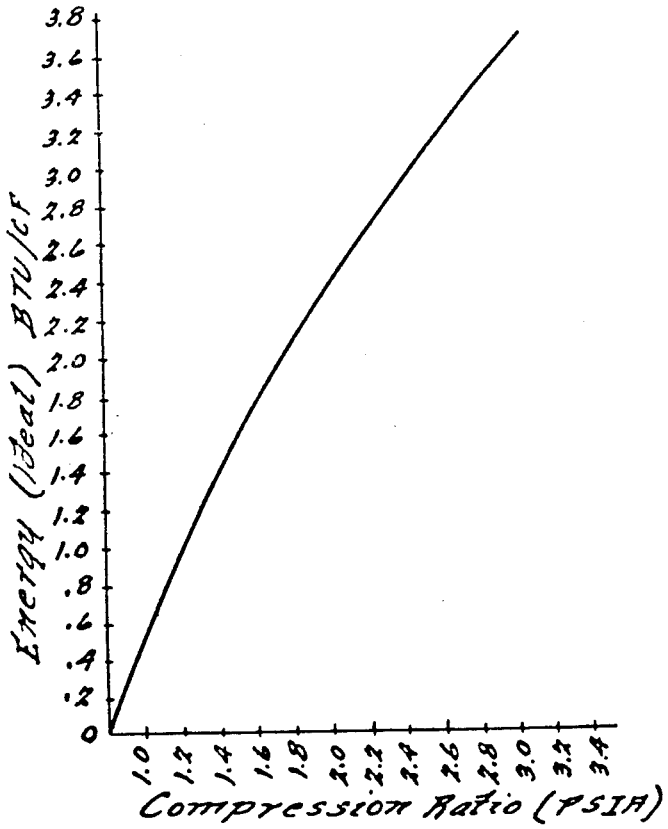
Fig. 6

METHOD OF CONTROLLING A MOTIVE POWER AND FLUID DRIVING SYSTEM

CROSS REFERENCE TO A RELATED APPLICATION

This application is a continuation-in-part of application Ser. No. 088,785, filed Oct. 29, 1979, entitled "Compressor and Engine Efficiency System and Method," scheduled to issue on May 18, 1982, as U.S. Pat. No. 4,330,237, and which is hereby incorporated by reference.

BACKGROUND AND SUMMARY OF THE INVENTION

The present invention relates generally to motive power and fluid driving systems, and particularly to a method of controlling these motive power and fluid driving systems.

In the above-identified parent case, a method and system were taught for increasing the operating efficiency of natural gas compressor and engine units. According to this method, the energy required to compress the natural gas was related to the energy consumed by the engine to determine the most efficient operation of the natural gas compressor and the engine as a unit. This energy relationship was expressed as an "energy quotient," and was employed as the basis of controlling the operation of the natural gas compressor and engine unit.

Under the above method, one or more of the control parameters (i.e., the compressor loading and/or the engine speed) are adjusted to substantially maximize the energy quotient for the unit. Since the individual energy efficiencies of the gas compressor and the engine driving the gas compressor are not addressed, it is possible for an adjustment of the control parameters to adversely affect the individual energy efficiency of the gas compressor or the engine. However, such an adjustment would nevertheless increase the combined efficiencies of the gas compressor and the engine as a unit. Thus, for example, while a manufacturer's specification may indicate a decrease in efficiency for the engine where the speed is decreased below some rated value, a decrease in the engine speed may achieve an increase in the combined efficiency of the gas compressor and the engine.

While the above method has been found particularly advantageous for natural gas engine driven compressors, it is believed that the principles of this method may also find application in other motive power and fluid driving systems. Thus, the control method may be utilized in systems which transfer or impart a driving force to fluids in addition to gas, such a variety of liquids with viscosities from water to molasses, or a combination of liquid and gas. Similarly, the control method may be utilized in systems employing motive power means other than engines for driving the compressor or other fluid driving means, such as an electrically powered motor.

Accordingly, it is a principle object of the present invention to provide a method of controlling a motive power and fluid driving system which substantially maximizes the energy efficiency of the system.

It is a more specific object of the present invention to provide a method of controlling a motive power and fluid driving system which substantially maximizes an energy quotient for the motive power and fluid driving system.

It is an additional object of the present invention to provide a motive power and fluid driving system which substantially maximizes the energy quotient for the motive power and fluid driving system at a predetermined capacity of fluid flow.

To achieve the foregoing objects, the present invention provides for a method of controlling a motive power and fluid driving system which includes the steps of sensing a plurality of operating parameters and at least one control parameter defining an energy quotient for the motive power and fluid driving system, and adjusting the control parameter to substantially maximize this energy quotient.

Additional advantages and features of the present invention will become apparent from a reading of the detailed description of the preferred embodiments which makes reference to the following set of drawings in which:

BRIEF DESCRIPTION OF THE DRAWINGS

FIG. 5 is a graph of the compressibility of natural gas as a function of gas pressure and temperature;

FIG. 6 is a graph of the ideal thermal energy required to compress natural gas as a function of the compression ratio;

DETAILED DESCRIPTION OF THE PREFERRED EMBODIMENT

Figures 1, 2, 3:
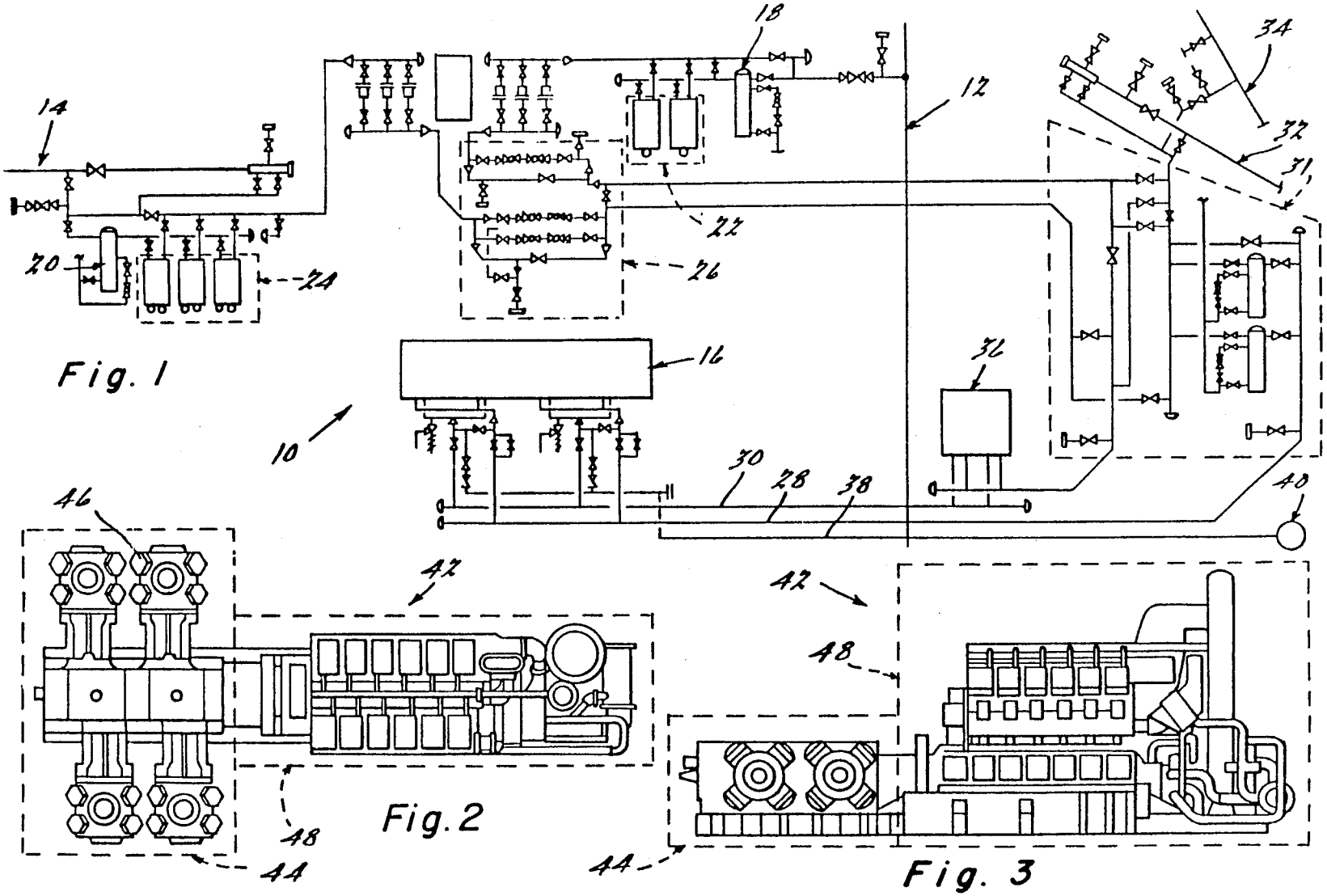
FIG. 1 is a diagrammatic view of a field or gathering gas compressor station.
FIG. 2 is a plan view of a gas compressor and engine unit used at the compressor station in FIG. 1.
FIG. 3 is a side elevation view of the gas compressor and engine unit in FIG. 2.

Referring to FIG. 1, a schematic diagram of a typical field or gathering gas compressor station 10 is shown. Compressor station 10 and the gas compressor and engine units contained therein are described hereinafter to illustrate one form of a motive power and fluid driving system applicable to the present invention. However, it should be understood that other forms of motive power and fluid driving systems may also be applicable to the present invention. The phase "motive power and fluid driving system" as used herein generally refers to the operative combination of at least one fluid driving apparatus and at least one motive power apparatus imparting a driving force to the fluid driving apparatus. The fluid being driven may comprise any fluid, including gases or liquids, a combination of gases and liquids, and slurries having solid particles contained therein. Suitable fluid driving apparatus include compressors, pumps, or other mechanical devices for driving, propelling, circulating, raising, exhausting, comprising, or otherwise imparting motion to a fluid. Suitable motive power apparatus include engines (such as internal combustion, steam, or turbine engines), motors (such as a.c. or d.c. powered motors), or other mechanical devices for converting energy into mechanical work, or otherwise imparting a moving force to a device. Thus, a motive power and fluid driving system in accordance with the present invention may comprise, for example, a liquid pump driven by an electrically powered motor, a gas compressor driven by a internal combustion engine, and so forth.

The compressor station 10 illustrated in FIG. 1 is suitable for use in injecting and withdrawing natural gas from two gas fields of a storing capacity on the order of 14.5 and 22.0 billion cubic feet of gas. Line 12 indicates the connecting pipeline for one field, and line 14 indicates the connecting pipeline for another field. Before the natural gas from these fields reaches the compressor building 16, several events must first occur. Scrubbers 18 and 20 remove any liquids or particles that may be present in pipelines 12 and 14, by letting them settle to the bottom of the scrubbers. Heaters 22 and 24 increase the temperature of the gas to prevent freezing the regulators 26. During the winter months when natural gas is being withdrawn from the fields, the pressure in the fields will be substantially greater than the pressure in the gas transmission lines. For example, the maximum pressure limit in these two fields might be 1780 psi; whereas the typical gas transmission line pressure is 800 psi. The regulators 26 provide the necessary pressure drop before the natural gas reaches the transmission line. However, a rapid decrease in pressure also acts to cool the gas at a rate of approximately 7° F. per 100 psi drop in pressure. Hence, the heaters will be needed to protect the regulators from freezing when the pressure in the field is much greater than that in the gas transmission line. Interposed between the heaters and the regulators are meters 22 and 24. These orifice type meters are used to measure the volume of gas flow from the fields.

The compressor building 16 contains two gas compressor and engine units, as indicated by the two sets of pipelines connected to the building. Both the suction gas pipeline 28 leading to the compressor building and the discharge gas pipeline 30 leaving from the compressor building have a 30 inch diameter. These two pipelines are connected through a series of valves and scrubbers 31 to pipelines 32 and 34, which are used to transport natural gas to and from another compressor station. The coolers 36 in discharge gas line 30 are used to reduce the temperature of the gas after compressing when the field is being charged with natural gas. Line 38 has a 4 inch diameter, and connects the compressor building with the blowdown stack 40. The blowdown stack is essentially a vent to atomsphere. It is used to purge the compressors of air before starting, and depressurize the compressors after shutdown. The valves generally designated at 31 also provide a direct connection between regulators 26 and gas transmission pipelines 32 and 34, so that the gas compressor and engine units in building 16 may be bypassed. It should be appreciated that this bypass connection allows the gas to be injected into the fields, or withdrawn from the fields directly from a downstream compressor station.

In operation, this compressor station charges the fields with natural gas during the summer months, and withdraws the gas from the field during the winter months. During the charging or injecting cycle, the fields may be charged from one or both of the compressor and engine units in building 16. Typically both compressor and engine units would be connected in parallel for single-stage operation until the pressure in the fields would reach 1330 psi. Then, under multiple-stage compression, the fields would be fully charged to 1780 psi. Typically, the downstream compressor station units would provide the first stage, and the units at compressor station 10 would provide the second stage. It may also be appreciated that the two units at compressor station 10 could be adapted to be connected in series for multiple-stage compression, rather than utilize the downstream compressor station units for the first stage. During the early withdrawal cycle, the pressure in the fields will be sufficient to transport the gas without resorting to the use of the compressor. Consequently, the valves at 31 will be actuated to provide a direct connection between the regulators and the gas transmission pipelines. When the pressure in the fields is no longer sufficient to transport a desired capacity or volume of gas, the units at compressor station 10 would again be utilized.

Referring to FIG. 2, a plan view of a gas compressor and engine unit 42 is shown. The compressor module 44 contains four identical ends 36, which each house a double-acting piston. The compressor may be characterized as a reciprocating, positive displacement, double-acting mechanism. The engine module 48 is a 12 cylinder, single-acting, reciprocating, V-type internal combustion engine. This engine operates on natural gas, and is rated at 4000 brake horsepower (BHP). FIG. 3 illustrates a side elevation view of this gas compressor and engine unit. The overall length of this unit is 39 ft., 7 in., the maximum width across the compressor ends is 18 ft., 8 in., and the maximum height at the engine is 15 ft., 4 in.

The two gas compressor and engine units at compressor station 10 are similar to the unit shown in FIGS. 2 and 3. The primary difference is that the engine modules at compressor station 10 contain 8 cylinders, and are each rated at 2000 BHP.

Figure 4:
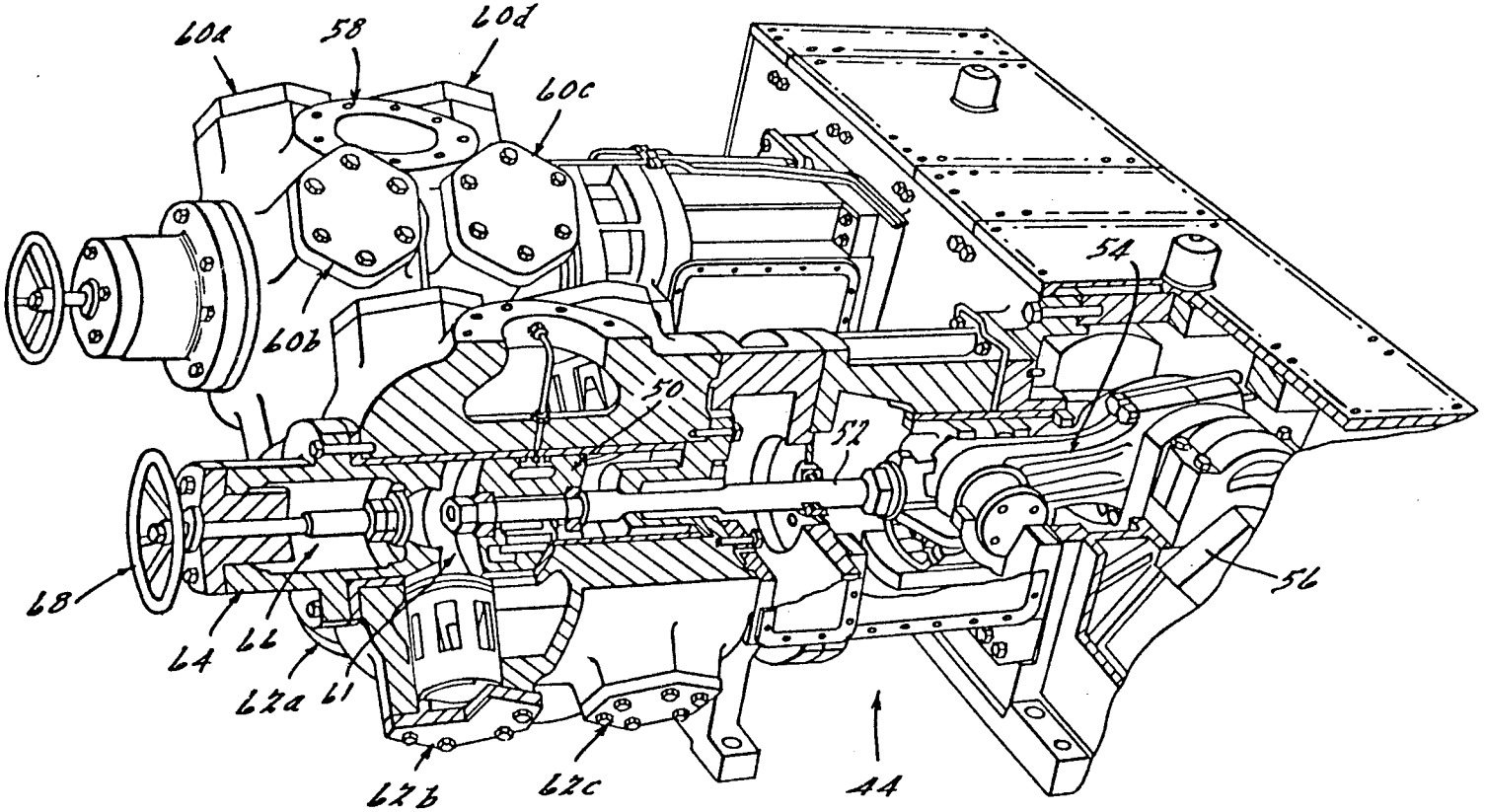
FIG. 4 is a fragmentary cut-a-way perspective view of a gas compressor of FIGS. 2 and 3.

Referring to FIG. 4, a fragmentary cut-a-way prospective view of the compressor module 44 is shown. Each compressor cylinder end 46 contains a single double-acting piston 50. Piston rod 52 is attached to piston 50 at the cylinder head end, and is attached to connected rod 54 at the crank end. Connecting rod 54 is secured to crankshaft 56, which is in turn coupled to the engine module 48. A suction gas port 58 is located at the top of each compressor cylinder end 46, and an identical port located at the bottom of the cylinder ends is used for the gas discharge. Adjacent to each suction gas port are four plate and poppet type valves 60 (*a, b, c, d*), which control the flow of suction gas into the compression chamber 61 by responding to a pressure differential across the valve. The lower set of four valves 62 (*a, b, c, d*) adjacent to the discharge gas port control the flow of gas from the compression chamber 61. Cylinder head 64 contains a fixed volume pocket 66, which is controlled by handwheel 68. In addition to the manual clearance control shown, automatic control may be effected through the use of pneumatically actuated valves.

In operation, the capacity of gas flow (cubic feet/hour) from compressor module 44 may be controlled by three mechanisms. First, the speed of the engine will, of course, control the speed at which the pistons 50 reciprocate in the compression chamber 61. This affects the actual volume of gas displaced by the piston as it travels the length of its stroke, which is referred to as the piston displacement (PD). Second, the volume remaining in the compression chamber at the end of a discharge stroke, referred to as the cylinder clearance, may be adjusted by opening and closing pockets, such as fixed volume pocket 66. This affects the volumetric efficiency (VE), which is the ratio of the compression chamber capacity to the actual volume displaced by the piston. Third, the number of compressor ends 46 may be varied or an end may be changed to single-acting operation, by the use of unloaders (not shown) attached to the suction valves open, and thereby prevent the gas from being discharged from the compressor. For example, when piston 50 moves to the left (cylinder head end), valves 60 *c* and *d* would be opened to allow the gas to fill the portion of the compression chamber. At the cylinder head end, valves 60 *a* and *b* would be closed to prevent the gas from escaping back into the suction gas port, and valves 62 *a* and *b* would be open to allow the gas to be discharged from the cylinder head portion of the compression chamber, to the discharge gas port. If an unloader opened either suction valves 60 *a* or *b*, the gas in the compression chamber would preferentially escape back into the suction gas port rather than through discharge valves 62 *a* and *b*, due to the greater pressure at the discharge gas port than at the suction gas port. In this situation the compressor end would be characterized as single-acting, as only the portion of the compression chamber nearest the crank end would be pumping gas through the compressor. Similarly, if all of the suction valves 60 (*a, b, c, d*) were unloaded, no gas would be pumped through the compressor end even though the piston would be reciprocating at the same speed.

As an example of the foregoing, Table 1 illustrates the theoretical volume of gas displaced by the pistons as a function of various compressor loadings, for one of the gas compressor and engine units at compressor station 10. These values were calculated at the rated engine speed (600 rpm) of the engine module. Although there are four compressor ends 46 in compressor module 44, the terms "ends out" in Table 1 encompasses single as well as double-acting piston operation. In other words, the availability of single-acting operation provides in effect eight possible compressor ends which may be utilized to pump natural gas through the compressor. As indicated in the Table, the gas compressor and engine unit at compressor station 10 has been adapted to include one large (L) and two small (S) pockets for each compressor end 46. These pockets are attached to the compressor cylinder head, and are pneumatically actuated. The large pockets have a volume of 1027 cubic inch, and the small pockets each have a volume of 300 cubic inch. As stated previously, the number of pockets open or closed control the clearance volume left in the compression chamber after the piston has completed a compression stroke. As indicated in the Table, this volume may even exceed the volume of gas displaced by the piston stroke. Although the cylinder clearance does not affect the volume of gas displaced by the pistons, its does affect the volume of gas flowing from the compressor. As will be described later, the piston displacement is only one of several terms defining the capacity (Q) of gas flow from the compressor. The cylinder clearance also affects the torque on the engine, and in combination with the speed of the engine, the cylinder clearance provides an effective control of the torque.

TABLE I

THEORETICAL PISTON DISPLACEMENT AS A FUNCTION OF COMPRESSOR LOADING

| ENDS OUT | POCKETS OPEN | COMPRESSOR PISTONS DISPLACEMENT CF/HR | AVERAGE CYLINDERS CLEARANCE % |
|---|---|---|---|
| 0 | 0 | 134,550 | 30.67 |
| 0 | 1-S | " | 36.32 |
| 0 | 2-S | " | 39.98 |
| 0 | 4-S | " | 49.29 |
| 0 | 6-S | " | 58.60 |
| 0 | 8-S | " | 67.91 |
| 0 | 6S-1L | " | 74.54 |
| 0 | 8S-1L | " | 83.85 |
| 0 | 6S-2L | " | 90.48 |
| 0 | 8S-2L | " | 99.79 |
| 0 | 6S-3L | " | 106.42 |
| 0 | 8S-3L | " | 115.73 |
| 0 | 6S-4L | " | 122.35 |
| 0 | 8S-4L | " | 131.60 |
| 1 | 0 | 116,698 | 32.59 |
| 1 | 1-S | " | 37.98 |
| 1 | 2-S | " | 43.35 |
| 1 | 4-S | " | 54.08 |
| 1 | 6-S | " | 64.82 |
| 1 | 8-S | " | 75.55 |
| 1 | 6S-1L | " | 83.19 |
| 1 | 8S-1L | " | 93.93 |
| 1 | 6S-2L | " | 101.57 |
| 1 | 8S-2L | " | 112.30 |
| 1 | 6S-3L | " | 119.95 |
| 1 | 8S-3L | " | 130.68 |
| 2 | 0 | 98,846 | 35.25 |
| 2 | 1-S | " | 41.58 |
| 2 | 2-S | " | 47.92 |
| 2 | 4-S | " | 60.59 |
| 2 | 6-S | " | 73.27 |
| 2 | 8-S | " | 85.95 |
| 2 | 6S-1L | " | 94.97 |
| 2 | 8S-1L | " | 107.64 |
| 2 | 6S-2L | " | 116.66 |
| 2 | 8S-2L | " | 129.34 |
| 3 | 0 | 80,993 | 39.05 |
| 3 | 1-S | " | 46.78 |
| 3 | 2-S | " | 54.52 |
| 3 | 4-S | " | 69.98 |
| 3 | 6-S | " | 85.45 |
| 3 | 8-S | " | 100.92 |
| 3 | 6S-1L | " | 111.93 |
| 3 | 8S-1L | " | 127.39 |
| 4 | 0 | 63,137 | 45.00 |
| 4 | 1-S | " | 54.92 |
| 4 | 2-S | " | 64.84 |
| 4 | 4-S | " | 84.68 |
| 4 | 6-S | " | 104.52 |
| 4 | 8-S | " | 124.36 |

In describing the present invention, a particular nomenclature will be utilized. Although the nomenclature is more or less standard to those skilled in the art, a glossary providing definitions of the nomeclature is set forth in Table 2 for convenience and clarity.

TABLE 2

Glossary $A_h$ = area of the piston head (sq. in.)
$A_r$ = area of the piston rod (sq. in.)
BHP = brake horsepower
BTU = British thermal unit
CF/HR = cubic feet per hour
$D_d$ = discharge elevation with respect to a datum plane (ft)
$D_s$ = suction elevation with respect to a datum plane (ft)
$E_i$ = ideal energy required to compress natural gas (BTU/SCF)
E.Q. = energy quotient
$F_h$ = fuel heating value (BTU/SCF)
H = total pump head (ft-lbf/lbm)

TABLE 2-continued

| Glossary | |
|---|---|
| $H_{sg}$ = | suction fluid pressure (ft. Hg.) |
| Input = | energy needed to operate the motive power means (BTU/HR) |
| K = | ratio of specific heats |
| L = | length of piston stroke (in.) |
| LHP = | liquid horsepower |
| LHV = | lower heating value of fuel gas (BTU/SCF) |
| MM-BTU/HR = | millions of BTU per hour |
| N = | speed (rpm) |
| Output = | $Q \times Z_3 \times E_i$ (BTU/HR) |
| overall efficiency = | compressor cylinder efficiency × mechanical efficiency |
| P.D. = | piston displacement (CF/HR) |
| $P_d$ = | discharge fluid pressure (PSIG) |
| $P_s$ = | suction fluid pressure (PSIG) |
| Q = | capacity of fluid flow from the fluid driving means (SCF/HR for gas; GPM for liquids) |
| $R_c$ = | compression ratio = $P_d/P_s$ |
| SCF/HR = | standard cubic feet per hour |
| s.g. = | specific gravity |
| T = | torque |
| $t_s$ = | suction fluid temperature (°F.) |
| $V_d$ = | average discharge velocity (FPS) |
| V.E. = | volumetric efficiency |
| $V_e$ = | volume of fuel gas consumed by engine per hour (SCF/HR) |
| $V_s$ = | average suction velocity (FPS) |
| W = | specific weight of the liquid being pumped (lb/cu. ft) |
| $W_m$ = | specific weight of mercury (lb/cu. ft) |
| Z = | compressibility of gas |
| g = | acceleration due to gravity ft/sec$^2$ |

In order to evaluate the performance of a gas compressor and an engine as a unit, the concept of an energy quotient (E.Q.) was developed. The energy quotient is essentially the thermal efficiency of the gas compressor and engine as a unit, and is generally defined as $$E.Q. = \frac{\text{Output (BTU/HR)}}{\text{Input (BTU/HR)}} \quad (1)$$

The Output is the theoretical energy required to compress a certain volume of gas between given pressure limits, and the Input is the energy consumed by the engine driving the compressor. However, in the context of motive power and fluid driving systems generally, the Output is the energy transferred to the fluid by the fluid driving apparatus, and the Input is the energy consumed by the motive power means which drives the fluid driving apparatus.

Before proceeding to set forth the equations defining the Output and Input for gas compressor and engine units, several terms used in these equations will first be described. The volume of gas displaced per hour by a double acting piston is defined by $$P.D.\ (\text{SCF/HR}) = \frac{(2Ah - Ar) \times L \times N}{28.8} \quad (2)$$

at standard conditions of 14.7 (PSIG) gas pressure and 60° (F.) gas temperature. The volumetric efficiency (V.E.) is the ratio of actual cylinder of compression chamber volume to piston displacement (P.D.), and is defined as $$\text{V.E.} = 0.98 - C_v(R_c^{1/k} - 1), \quad (3)$$

where the ratio of specific heats (k) for natural gas is approximately 1.3.

The compressibility of gas (Z) is a dimensionless factor which varies with temperature and pressure. FIG. 5 illustrates a graph of the theoretical compressibility of natural gas, based on a specific gravity of 0.6. The theoretical volume per hour of gas flow from the compressor, capacity (Q), is defined by $$Q(\text{SCF/HR}) = P.D. \times V.E. \times \frac{\text{Actual } N}{\text{Rated } N} \times \frac{P_s}{14.7} \times \frac{1}{Z_s} \quad (4)$$

The final term necessary to define the Output of the compressor is the ideal thermal energy ($E_i$) required to compress the gas at standard temperature and pressure conditions. FIG. 6 illustrates a graph of the ideal (frictionless adiabatic) energy required as a function of the compression ratio ($R_c$). This curve was calculated for natural gas with a specific gravity of 0.6 and a k of 1.3. The Output may now be defined as $$\text{Output (BTU/HR)} = Q \times Z_s \times E_1, \quad (5)$$

where $Z_s$ is the compressibility of the suction gas. The Input is defined as $$\text{Input (BTU/HR)} = V_e(\text{SCF/HR}) \times F_h(\text{BTU/SCF}), \quad (6)$$

where the fuel heating value ($F_h$) is assumed to be the lower heating value (LHV) of the fuel gas.

Although the energy quotient provides an excellent criterion by which the performance of a gas engine and compressor unit may be evaluated, it does not supply all of the information necessary to control the operation of the unit in accordance with the present invention. The brake horsepower (BHP) required from the engine and the percent torque (T) on the engine are also needed; and are calculated as follows.

$$\text{BHP} = \frac{\text{Output (BTU/HR)}}{2545\ (\text{BTU/BHP-HR}) \times \text{Overall Efficiency}} \quad (7)$$

Figure 7:
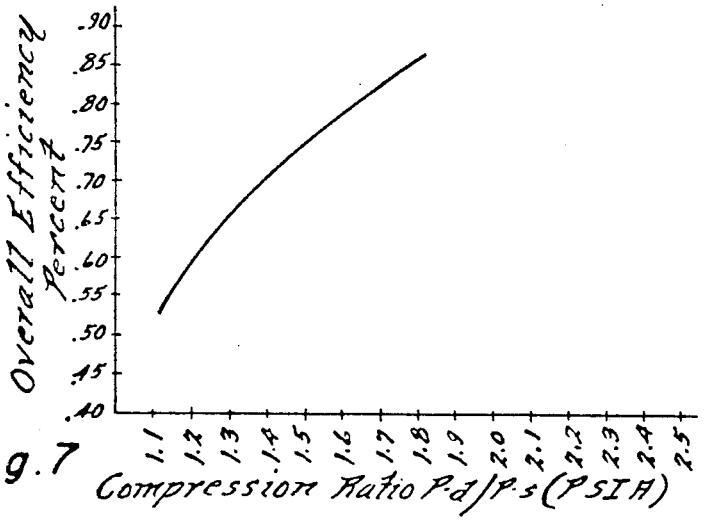
FIG. 7 is a graph of the overall efficiency of a typical gas compressor and engine unit for the gas compressor station in FIG. 1.

The overall efficiency is the compressor cylinder indicated efficiency multiplied by the mechanical efficiency of the driving means. FIG. 7 illustrates a graph of the overall efficiency as a function of the compression ratio for a particular unit:

$$\text{BHP\%} = \frac{\text{Calculated Actual BHP}}{\text{Rated BHP}} \quad (8)$$

$$T\% = \text{BHP\%} \times \frac{\text{Rated } N\ (\text{rpm})}{\text{Actual } N\ (\text{rpm})} \quad (9)$$

The practical application of the above principals in the control of one or more gas compressor and engine units will now be described. One of the primary concerns in the operation of a compressor station or unit is the amount of gas (volume/hour) being transferred through the pipeline. During the time when gas is being stored in a field for future use, the amount of gas being injected into the field would normally not be considered critical. In fact, this would generally be dependent upon the geological formation of the field. However, when gas is being withdrawn from the field to meet a required demand by the consumer, the maintenance of a constant volume of gas flow from the field is quite important. This is especially true in the winter months when natural gas is being used to heat many residential homes.

Consequently, the situation may arise where the station or unit is adjusted to move the gas in the most efficient manner, even though the volume of gas transferred is somewhat reduced. Further, the situation may arise where the volume of gas being transferred is controlling, and the efficiency of the station or unit can only be optimized within this constraint.

In terms of the field compressor station 10 illustrated in FIG. 1, the following basic control options exist: one unit may be utilized to transfer gas; both units may be combined in parallel; both units may be combined in series (multiple-stage compression); the gas pressure in the fields may be sufficient to transfer gas from the field without the units; or the down stream station may be utilized to transfer gas to or from the fields (single or multiple-stage).

In the situation where one gas compressor and engine unit is utilized and the volume of gas flowing from the compressor is not critical, then in accordance with the present invention the unit should be operated so that the energy quotient (E.Q.) is maximized. This is accomplished through adjustments of the speed of the engine (N) and the loading on the compressor. As described previously, compressor loading adjustments are performed by varying the number of compressor ends 46 being utilized to pump the gas, and varying the cylinder clearance volume ($C_c$).

As the engine speed and compressor loading are the only two parameters which may be directly controlled, they will be referred to as the "control parameters". The remaining parameters which may be physically sensed during the operation of a unit, will be referred to as the "operating parameters". These include the suction gas pressure ($P_s$), the discharge gas pressure ($P_d$), the suction gas temperature ($t_s$), the capacity of gas flow from the compressor (Q), the volume of fuel gas consumed by the engine ($V_e$), and the lower heating value of the fuel gas (LHV).

Figure 8:
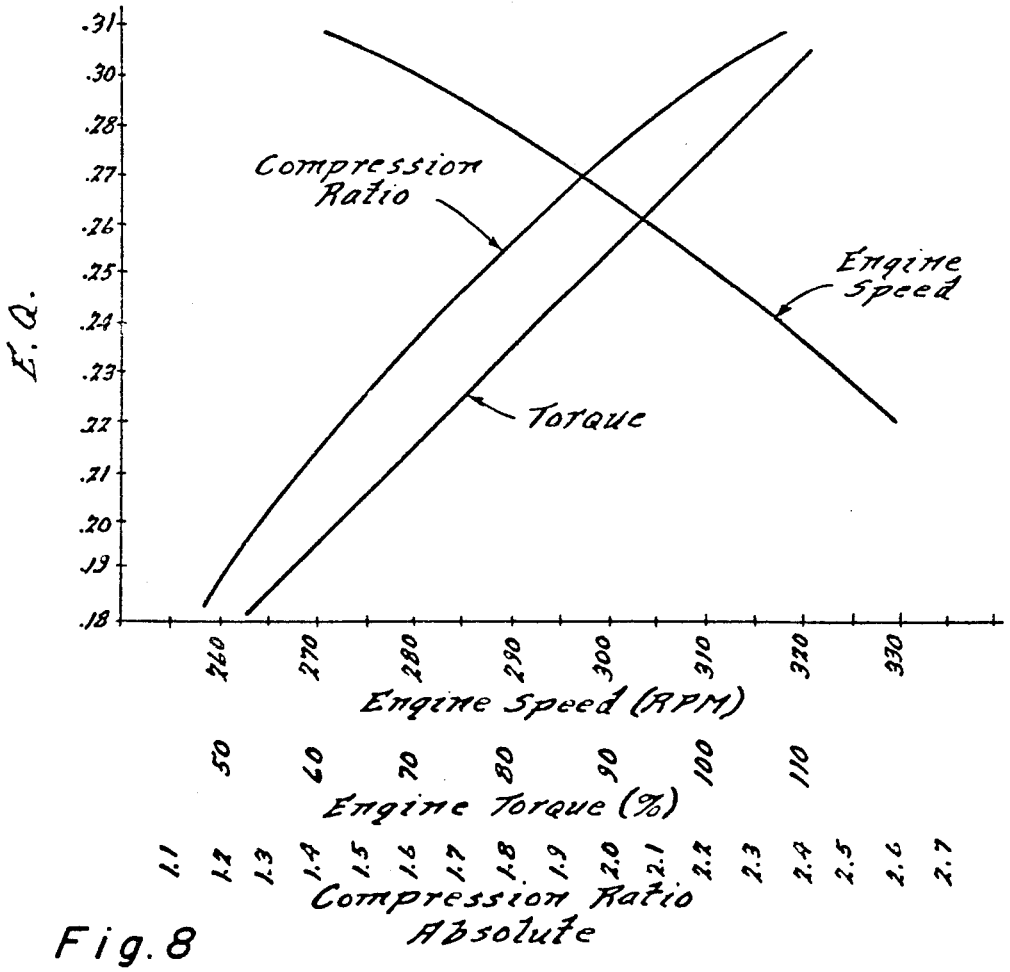
FIG. 8 is a composite graph depicting the relationship between various parameters and the energy quotient for a typical gas engine and compressor unit.
Figure 9:
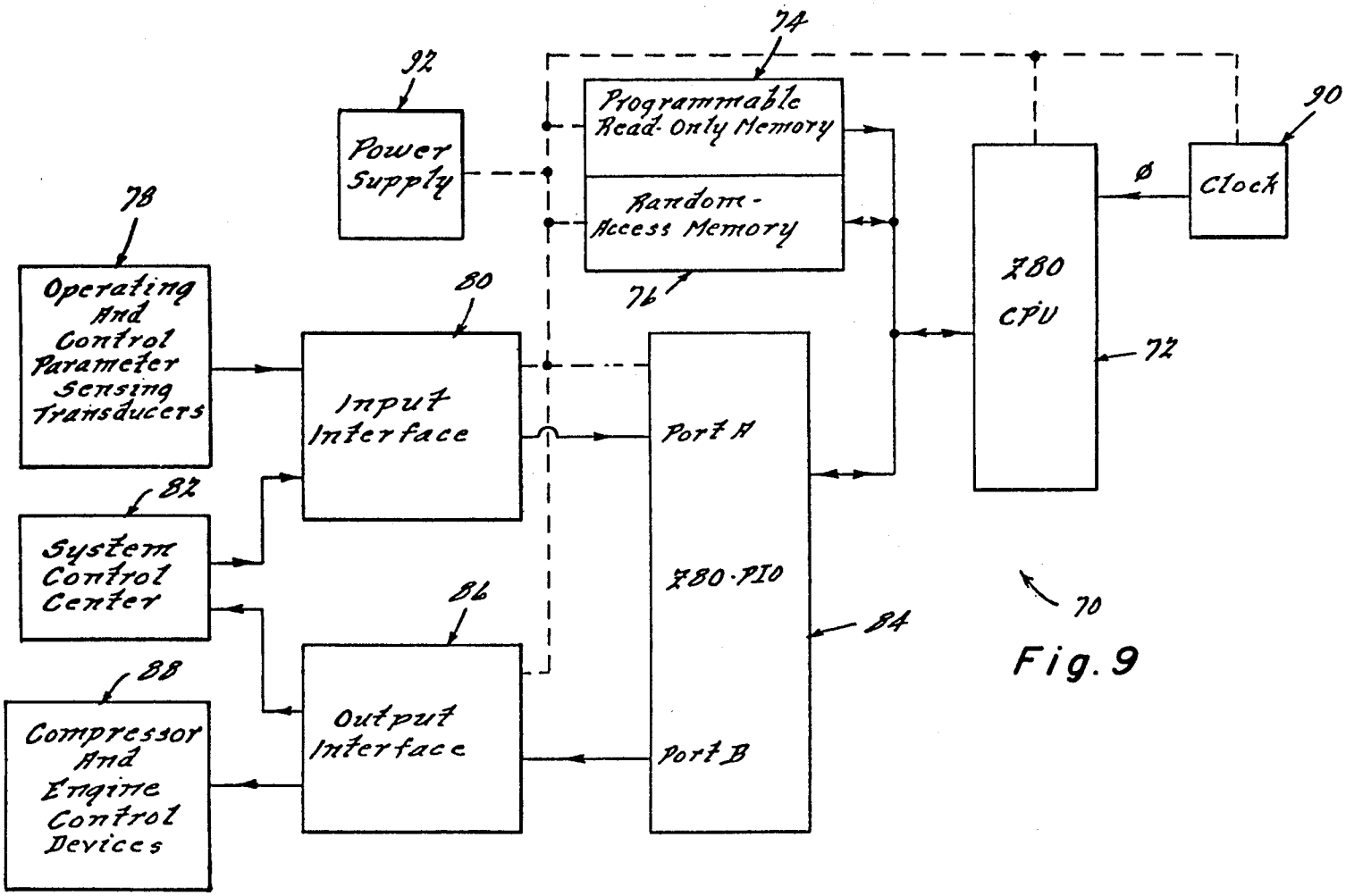
FIG. 9 is a block diagram showing the various elements and connections thereto for an electronic controller for use in accordance with this invention.

The effect of the engine speed (N), the engine torque (T), and the compression ($R_c$) on the energy quotient for a unit is illustrated in FIG. 8. This composite graph was taken from experimental data on another type of gas compressor and engine unit than that disclosed herein. Each curve was based on maintaining the other two parameters (N, T, or $R_c$) constant. It may be observed that the energy quotient decreases when the engine speed increases. As the rate speed for this unit is 330 (rpm), it is apparent that the engine should be operating at a lower speed to maximize the efficiency of the unit. For the purpose of the present invention, the effect of the engine speed on the efficiency of the engine itself is unimportant, and should be distinguished from the efficiency of the compressor and engine as a unit.

With reference to the torque on the engine, it may be observed that the energy quotient increases linearly with an increasing torque. From this curve it is apparent that the unit operates most efficiently when the torque on the engine is approximately 100% of the rated torque. As stated previously, the torque on the engine is controlled by the engine speed and the compressor loading. Therefore, a gas compressor and engine unit should be controlled so that the compressor loading maximizes the engine torque while maintaining the engine speed at the minimum value necessary to pump the desired capacity of natural gas through the compressor.

The third curve in FIG. 8 illustrates the relationship between the compression ratio ($R_c$) and the energy quotient of the unit. As indicated, the compression ratio has a substantial effect on the energy quotient. However, the compression ratio is one of the least controllable parameters in the operation of the unit. For example, when natural gas is being withdrawn from the field, the suction gas pressure ($P_s$) at the compressor will be dependent upon the gas pressure in the field as well as the capacity of gas being drawn from the field.

The compression ratio is also important because it is the only sensed parameter which changes during the normal operation of a gas compressor and engine unit. However, the variation in this one parameter also affects the compressibility of the gas (Z), the volumetric efficiency (V.E.), the ideal energy required to compress the gas ($E_i$) and the overall efficiency of the unit. Variations in these factors in turn affect the capacity of gas flow (Q), and the energy quotient (E.Q.). Consequently, in order to operate a unit so that the energy quotient is maximized, the compression ratio must be monitored or sampled at determinable intervals. Thus, when the compression ratio changes, the control parameters may be adjusted in response to this change to either attempt to maintain the original energy quotient, or achieve the highest energy quotient under the particular circumstances. It should also be noted that when either of the control parameters are adjusted, the compression ratio will again be changed. Therefore, this adjustment process will typically be an iterative one.

In the situation where a specific capacity of gas flow from the compressor must be maintained, the following exemplifies the proper control steps to be taken. Assuming that the unit is withdrawing gas from the field and the suction gas pressure decreases, then the capacity (Q) will also decrease. First, the engine torque (T) must be sensed or otherwise examined in order to determine if it is below the rate torque for the engine. If the torque may be increased, then the option exists to increase the engine speed or the compressor loading. In accordance with the present invention, it is preferred that the loading on the compressor be adjusted before adjusting the speed on the engine. After the loading has been increased by a fixed increment, such as closing a pocket or adding another compressor end, then the system must be allowed time to stabilize. This is because the compression ratio will be changed by the increased capacity (Q). After this time period, the torque must be determined again. If the torque is still below the rated torque, the compressor loading may be increased another step. This process is repeated until the desired capacity is obtained, or the compressor is at maximum loading. If the desired capacity cannot be achieved at maximum loading, then the engine speed may be increased. Again, the increase in engine speed should not be such as to increase the engine torque beyond the maximum torque for the unit. Where the desired capacity is achieved at a compressor loading less than the maximum available, then the compressor loading and engine speed should be adjusted so that the torque on the engine is maximized and the engine speed is at the minimum value necessary to pump the desired capacity.

In the situation where two gas compressor and engine units are combined in parallel, the units may be operated essentially independent of one another. However, when the units are combined in series for multiple-stage operation, the units are considered together under the present invention. Rather than optimize the efficiency of one unit or the other, the units are controlled so that the energy efficiency for the sum of both units is optimized. Particularly, the inter-stage pressure is controlled, while still maintaining an essentially equal capacity of gas flow from each unit. By controlling the inter-stage pressure, the compression ratio for each unit may be controlled. Thus, where two similar units are utilized, the inter-stage pressure would be adjusted so that the compression ratio for each unit would be approximately equal. However, where the units are not matched, this adjustment would be dependent upon the particular units used. For example, one unit may have a relatively low energy quotient at a certain compression ratio, whereas another unit would have a higher energy quotient at a lower compression ratio. Thus, in this situation the inter-stage pressure would be adjusted so that the relatively inefficient unit would have a higher compression ratio than the more efficient unit.

The above control method may also be adapted to predict impending gas compressor and engine unit failures. This would be accomplished by comparing the current energy quotient value for the unit with a standard or base value energy quotient, determined from curves similar to those in FIG. 8. When the difference between these energy quotient values exceeds a predetermined value, the unit would then be examined for defects. With respect to the compressor module, such defects could include worn out cylinder rider bands or rings, worn rod packings, or defective suction or discharge valves. In the engine module, such defects could be related to the engine timing, the spark plugs, exhaust or intake valves, the power piston rings, or the turbocharger. On method of determining whether a defect exists in the compressor module or in the engine module is to calculate the current energy quotient value on the basis of the actual capacity (Q) of gas flow from the compressor. One or more elbow meters, standard in the art, would be connected to the outlet pipeline from the compressor to sense the actual capacity. By comparing the energy quotient value based on the calculated capacity with the energy quotient value based on the sensed capacity, the general location of the defect may be determined. For example, if the difference between these values is small, then the problem would be with the engine module, as the compressor would be pumping the capacity of gas it should be pumping.

The above control methods may also be embodied in an automatic controller device to achieve and maintain the maximum energy quotient for one or more gas compressor and engine units. It may be appreciated by one skilled in the art that such a device could be constructed from analog or digital circuitry. However, a digital controller based upon a microprocessor unit will be described here. FIG. 10 illustrates a block diagram of a microprocessor based controller 70 according to the present invention. The central processing unit 72 may be of a type standard in the industry, such as the Zilog Z80 microprocessor chip. The programmable read-only-memory 74 will contain the program for directing the operation of the controller device 70. The random access memory 76 would be used to store the various parameter values being sensed by input transducers 78, and store the results of the calculations incident to the control of the gas compressor and engine unit. Input interface 80 is used to receive the signals from input transducers 78 and system control center 82 for signal processing before being sent to parallel input-output port 84. Such signal processing would generally analog to digital conversion and digital signal multiplexing. Examples of typical interfacing schemes standard in the art may be found in Automated Process Control Systems: Concepts and Hardware, Prentice-Hall, Inc., R. P. Hunter, 1978. Input-output port 84 is also used to transmit signals to output interface 86, which essentially provides the reverse function of input interface 80. The signals from output interface 86 may then be sent to system control center 82, or to control devices 88. System control center 82 is used to provide operator access to controller device 70, and would include a keyboard, a printer, and a cathode ray tube display. Control devices 88 would be used to control the engine speed, compressor pocket clearance, and compressor pneumatic-type unloader valves. Oscillator/clock 90 is used to provide the timing signals necessary to operate central processing unit 72. Power supply 92 is used to provide the electrical power needed to operate control processing unit 72, memories 74 and 76, clock 90, input-output port 84, and interfaces 80 and 86.

In operation, control commands such as to initiate the operation of the gas compressor and engine unit may be entered into controller device 70 via the keyboard in system control center 82. Such commands may include the specification of a desired capacity (Q), percent rated torque, or energy quotient; or a range thereof within which the controller may operate. The central processing unit would then compare the capacity, torque, and energy quotient values with the desired values stored in memory 76. Control signals would then be generated and sent to interface 86, where the control parameters would be adjusted in response to the above comparison.

With respect to control methods for motive power and fluid driving systems other than gas engine driven compressors, the control methods and apparatus described above for gas engine driven compressors may in general be applied. However, since some fluid driving apparatus are not equipped with means for controlling the torque on the engine or other motive power apparatus, it should be noted that the speed parameter may be the only control parameter in the system. Nevertheless, other fluid driving appratus may be provided with torque controlling means other than unloading valves, such as variable pitch impeller blades. Additionally, since some motive power apparatus are designed to operate at a constant speed (such as certain types of electrically powered motors), the torque parameter may be the only control parameter in the system. However, a suitable transmission mechanism may be interposed between the motive power apparatus and the fluid driving apparatus to alter the rotating or reciprocable speed imparted to the fluid driving apparatus.

Accordingly, the method of controlling a motive power and fluid driving system according to the present invention includes the steps of sensing a plurality of operating parameters and at least one control parameter defining the energy quotient for the motive power and fluid driving system, and adjusting the control parameter(s) to maximize or substantially maximize the energy quotient for the system. The control method may also include one or more of the steps discussed above with respect to gas engine driven compressors, such as substantially maximizing the energy quotient at a predetermined or desired capacity of fluid flow.

It should also be noted that the equations used to determine the Output and Input values of equation (1), which define the energy quotient, may be modified without departing from the spirit and scope of the present invention. For instance, when an electrically powered motor is employed as the motive power apparatus, the Input value will be defined in terms of the number of watts consumed per unit of time. Additionally, the Output value may be derived from the product of the capacity (Q) of fluid flow and the total head (H) developed by the fluid driving apparatus. The total head developed by a fluid driving apparatus, such as a pump, is a measure of the energy imparted to the fluid being driven or pumped.

The total head developed by a pump may be expressed as the difference between the total discharge head (hd) and the total suction head (hs), as follows:

$$H = hd - hs, \tag{10}$$

where $$hd = \frac{144Pg}{W} + Dd + \frac{Vd^2}{2g} \tag{11}$$

and $$hs = \frac{Wm}{W}\, hsg - Ds + \frac{Vs^2}{2g} \tag{12}$$

The nomenclature for the variables identified in equations (11) and (12) may be found in the glossary of Table 2. The total head value (H) is expressed in terms of foot-pound-force per pound-mass (ft-l bf/l bm). This head value may be combined, for example, with the capacity value (Q) for water to define the Output, as follows:

$$\text{Output (BTU/HR)} = \frac{H\ (\text{ft-lbf/lbm})}{778\ (\text{ft-lbf/BTU})} \times Q\ (\text{gpm}) \times 8.33\ (\text{lbm/g}) \times 60\ (\text{min/HR}) \tag{13}$$

Additionally, the total head (H) may be related to the brake horsepower (BHP), as follows:

$$LHP = \frac{Q\ (\text{gpm}) \times H\ (\text{ft-lbm/lbm})}{3{,}960} \tag{14}$$

where the conversion factor "3960" is derived by dividing 33,000 (ft-1 bf/min) by 8.33 (1 bm/g) for water, and $$\text{BHP} = \frac{LHP}{\text{overall efficiency}}$$

Thus, it should be appreciated that the equations used to determine the Output and Input values are not limited solely to the equations employed for gas engine driven compressors, and may be modified to reflect the particular motive power and fluid driving system employed.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

I claim:

1. A method of controlling a motive power and fluid driving system, comprising the steps of:

(a) sensing a plurality of operating parameters and at least one control parameter defining an energy quotient for said motive power and fluid driving system; and (b) adjusting said control parameter to substantially maximize said energy quotient for said motive power and fluid driving system.

2. The method according to claim 1, wherein said adjusting step is responsive to changes in said operating parameters.

3. The method according to claim 2, wherein said sensing step occurs at predeterminable intervals.

4. The method according to claim 3, wherein said control parameter is associated with a speed value.

5. The method according to claim 4, wherein said motive power and fluid driving system includes a fluid pump drived by a motor.

6. The method according to claim 5, wherein said fluid pump is a liquid pump.

7. The method according to claim 5, wherein said motor is an electrically powered motor.

8. The method according to claim 3, wherein said control parameter is associated with a torque value.

9. The method according to calim 3, wherein two control parameters are sensed, and said control parameters comprise a torque value and a speed value.

10. A method of controlling a motive power and fluid driving system, comprising the steps of:

(a) sensing a plurality of operating parameters and at least one control parameter defining an energy quotient for said motive power and fluid driving system; and (b) adjusting said control parameter to substantially maximize said energy quotient for said motive power and fluid driving system at a predetermined capacity of fluid flow.

11. The method according to claim 10, wherein said adjusting step is responsive to changes in said operating parameters.

12. The method according to claim 11, wherein said sensing step ocurrs at predeterminable intervals.

13. The method according to claim 12, wherein said control parameter is associated with a speed value.

14. The method according to claim 13, wherein said motive power and fluid driving system includes a fluid pump drived by a motor.

15. The method according to claim 14, wherein said fluid pump is a liquid pump.

16. The method according to claim 14, wherein said motor is an electrically powered motor.

17. The method according to claim 12, wherein two control parameters are sensed, and said control parameters comprise a torque value and a speed value.

18. A method of controlling a motive power and fluid driving system, having fluid driving means for transferring fluid, motive power means for imparting a driving force to said fluid driving means, first means for regulating the torque on said motive power means, and second means for regulating the speed of said fluid driving means, comprising the steps of:

(a) sensing the torque on said motive power means and the speed of said fluid driving means; and (b) adjusting said first and second means to substantially maximize the torque on said motive power means and to substantially minimize the speed of said fluid driving means.

19. The method according to claim 18, wherein said adjusting step also provides for a predetermined capacity of fluid flow from said fluid driving means.

20. A method of controlling a motor driven compressor system, having first means associated with said compressor for regulating the torque on said motor and second means associated with said motor for regulating the rotational speed of said compressor, comprising the steps of:

(a) sensing the torque on said motor and the rotational speed of said compressor;

(b) adjusting said first and second means to substantially maximize the torque on said motor and to substantially minimize the rotational speed of said compressor.

21. The method according to claim 20, wherein said adjusting step also provides for a predetermined capacity of fluid flow from said compressor.

* * * * *

UNITED STATES PATENT AND TRADEMARK OFFICE

CERTIFICATE OF CORRECTION

PATENT NO. : 4,486,148

DATED : 12/4/84

INVENTOR(S) : Husam Battah

It is certified that error appears in the above-identified patent and that said Letters Patent is hereby corrected as shown below:

Col. 2, line 56, "phase" should be --phrase--

Col. 2, line 66, "comprising" should --compressing--

Col. 4, Line 40, 41, "prospective" should --perspective-- OUR ERROR

Col. 6, line 53, "nomeclature" should be --nomenclature--

Col. 7, line 11, "$Z_3$" should be --$Z_s$--

Col. 8, line 49, after "$\frac{\text{Calculated Actual BHP}}{\text{Rated BHP}}$" add --x 100--

Col. 11, line 30,"On" should be --"One"--

Col. 12, line 39, "appratus" should --apparatus--

Col. 14, line 10, "drived" should be --driven--

UNITED STATES PATENT AND TRADEMARK OFFICE

CERTIFICATE OF CORRECTION

PATENT NO. : 4,486,148

DATED : 12/4/84

INVENTOR(S) : Husam Battah

It is certified that error appears in the above-identified patent and that said Letters Patent is hereby corrected as shown below:

Col. 14, line 17, "calim" should be --claim--

Col. 14, line 34, "occurrs" should be --occurs--

Col. 14, line 39, "drived" should be --driven--

Signed and Sealed this

*Twenty-seventh* Day of *August 1985*

[SEAL]

*Attest:*

DONALD J. QUIGG

*Attesting Officer*

*Acting Commissioner of Patents and Trademarks*